US005211618A

United States Patent [19]

Stoltz

[11] Patent Number: 5,211,618

[45] Date of Patent: May 18, 1993

[54] SELF-CENTERING LAMINATED PROCESS FOR CORRUGATED CONTAINERS AND BLANK THEREFOR

[75] Inventor: Dennis J. Stoltz, Austell, Ga.

[73] Assignee: The Mead Corporation, Dayton, Ohio

[21] Appl. No.: 923,494

[22] Filed: Aug. 3, 1992

[51] Int. Cl.[5] ..... B31B 1/90

[52] U.S. Cl. ..... 493/96; 493/98; 493/110; 493/111; 493/379; 493/386

[58] Field of Search ..... 493/68, 76, 77, 96–98, 493/110, 111, 114, 379, 380, 381, 386, 389; 156/201, 202

[56] References Cited

U.S. PATENT DOCUMENTS

| | | | |
|---|---|---|---|
| 1,402,259 | 1/1922 | Smith | 493/68 |
| 1,591,061 | 7/1926 | Smith . | |
| 1,745,385 | 2/1930 | Smith | 493/68 |
| 2,021,254 | 11/1935 | Claff | 493/96 |
| 4,368,052 | 1/1983 | Bitsky et al. . | |
| 4,608,038 | 8/1986 | Virta | 493/141 |

*Primary Examiner*—Bruce M. Kisliuk
*Assistant Examiner*—Jack Lavinder
*Attorney, Agent, or Firm*—Needle & Rosenberg

[57] ABSTRACT

A process for the automatic centering of a corrugated liner onto a corrugated blank, comprising the steps of providing a pair of opposed, longitudinally extending first fold lines in the blank with the distance between the first fold lines being the width of the liner and defining therebetween a central portion on the blank; providing a pair of longitudinally extending second fold lines adjacent the sides of the blank and that are parallel to the first fold lines, the first and second fold lines being spaced apart a distance equal to the thickness of the liner and an outer edge panel being defined on the blank between the second fold line and the sides of the blank; gluing the liner generally onto the central portion of the blank; folding the outer edge panels 90° upwardly about the first fold line; and bending downwardly the outer edge panels another 90° to contact the liner. A blank for use in such process is also disclosed.

5 Claims, 2 Drawing Sheets

SELF-CENTERING LAMINATED PROCESS FOR CORRUGATED CONTAINERS AND BLANK THEREFOR

BACKGROUND OF THE INVENTION

This invention relates to the manufacture of corrugated containers and, more particularly, to a process of self-centering a corrugated liner member onto a container blank and a blank for use in such a process.

In the construction of corrugated containers, it is common to place or glue a liner member on the inner surface of a box blank to form a laminated structure. Usually, the fluting of the liner is transverse to the fluting of the blank to increase the rigidity of the assembled product. During the blank folding process, the liner may become misaligned if it has not been precisely centered in its correct position on the blank. Such misalignment can comprise a portion of the liner overlying one or more of the fold lines on the blank. Usually, the placement of the liner member onto the blank is done by hand to attempt to insure the correct placement of the liner. Therefore, a process has been needed to eliminate the labor-intensive step of precisely situating the liner on the blank.

SUMMARY OF THE INVENTION

The above disadvantages are overcome by the present invention which comprises a self-centering laminated process for corrugated containers and the blank therefor. A corrugated container blank is provided with a pair of parallel, longitudinally extending first and second fold lines along its inner surface. Each of the second fold lines is adjacent the outer side edge of the blank, with an outer edge panel being defined between each second fold line and each of the respective outer side edges of the blank. The distance between each first and second fold line approximates the thickness of the liner and the distance between the inner, first fold lines defines a central portion on the blank which is the width of the inner liner member.

The laminating process is as follows: glue is applied to the inner surface of the blank and the liner member is then generally positioned on the central portion of the blank. Alternatively, glue may first be applied to the underside of the liner which is then positioned onto the blank; glue is then applied to the inner surfaces of the outer edge panels.

The outer edge panels are then simultaneously folded upwardly 90° about the first fold lines which automatically aligns the liner member on the blank so that the sides of the liner are in alignment with the first fold lines. The outer edge panels are then folded inwardly another 90° about the fold lines so that the outer edge panels now overly the liner. The laminated assembly can then be fed to a pressure roll conveyor to complete the bonding process.

The folding of the outer edge panels upon the top of the liner member not only centers the liner onto its desired position overlying the central portion of the blank, but also provides a cosmetically appealing appearance to the erected container by covering the fluting of the exposed sides of the liner.

DETAILED DESCRIPTION OF THE PREFERRED EMBODIMENTS

Figure 3:
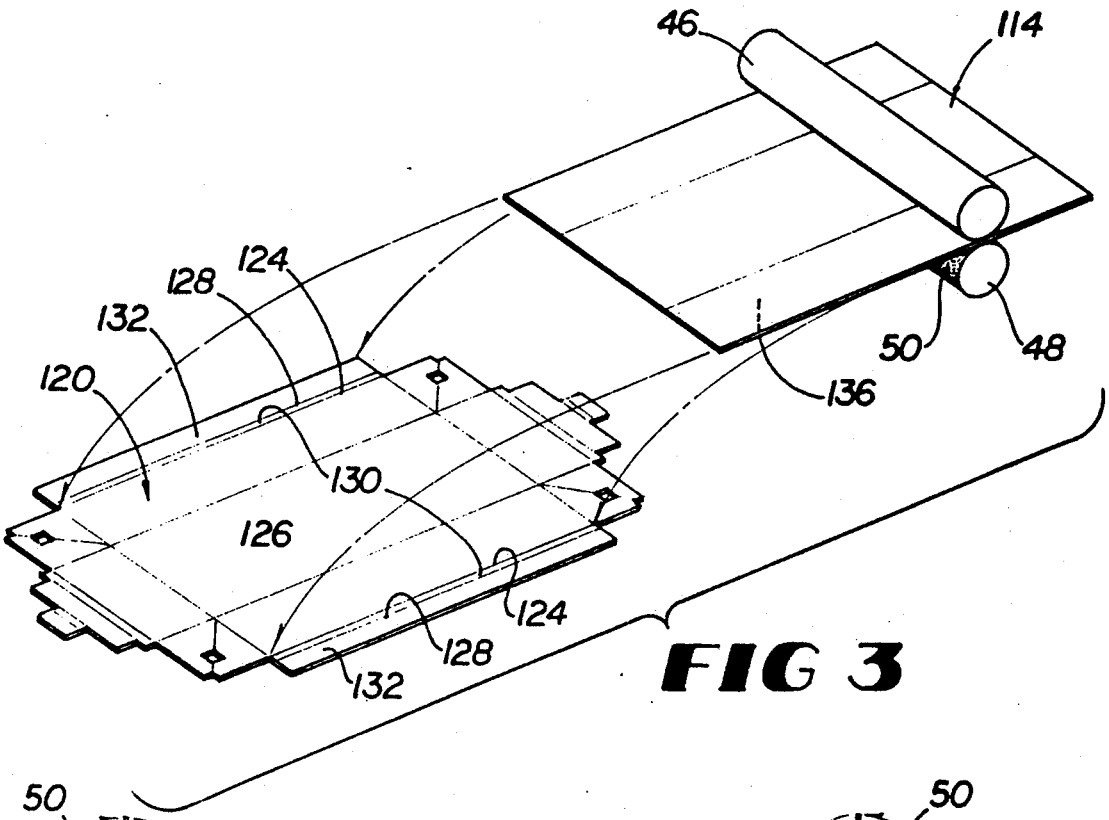
FIG. 3 is a schematic view of an alternate embodiment of the present invention.

Referring to the figures of the drawing, the numeral 10 refers to the finished laminated assembly of the corrugated container blank 12 and the corrugated inner liner 14. The blank 12 can be for any type of container or box which requires an inner liner 14 for strengthening purposes. The blank 12 will probably include additional elements such as other fold lines and cut lines, as depicted in FIG. 3. Thus, the blank 12 is meant to represent only the relevant portion of an otherwise conventional blank for corrugated containers.

As shown, the blank 12 is one-piece and has inner and outer surfaces 16, 18 and front and side edges 20, 22. A pair of longitudinally extending, parallel first fold lines 24 are formed on the inner surface 16. The first fold lines 24 border a rectangular central portion 26. Spaced from the first fold lines 24 is a second fold line 28, thereby forming intermediate panel 30 therebetween. An outer edge panel 32 on the blank 12 is defined between the second fold line 28 and the side edge 22. The length of the panels 32 and the fold lines 24, 28 is approximately equal to the length of the liner member 14.

The liner member 14 is rectangular in shape, having top and bottom surfaces 34, 36 and end and side walls 38, 40. The width of the liner 14 between its side walls 40 is the same as the width of the central portion 26 (i.e., the distance between the first fold lines 24). The height of the liner 14 from its top and bottom surfaces 34, 36 is equal to the width of the intermediate panel 30 (i.e., the distance between the first and second fold lines). Usually, the fluting of the blank 12 and the liner 14 is transverse to the other in order to provide extra strength to the finished container.

Figure 1:
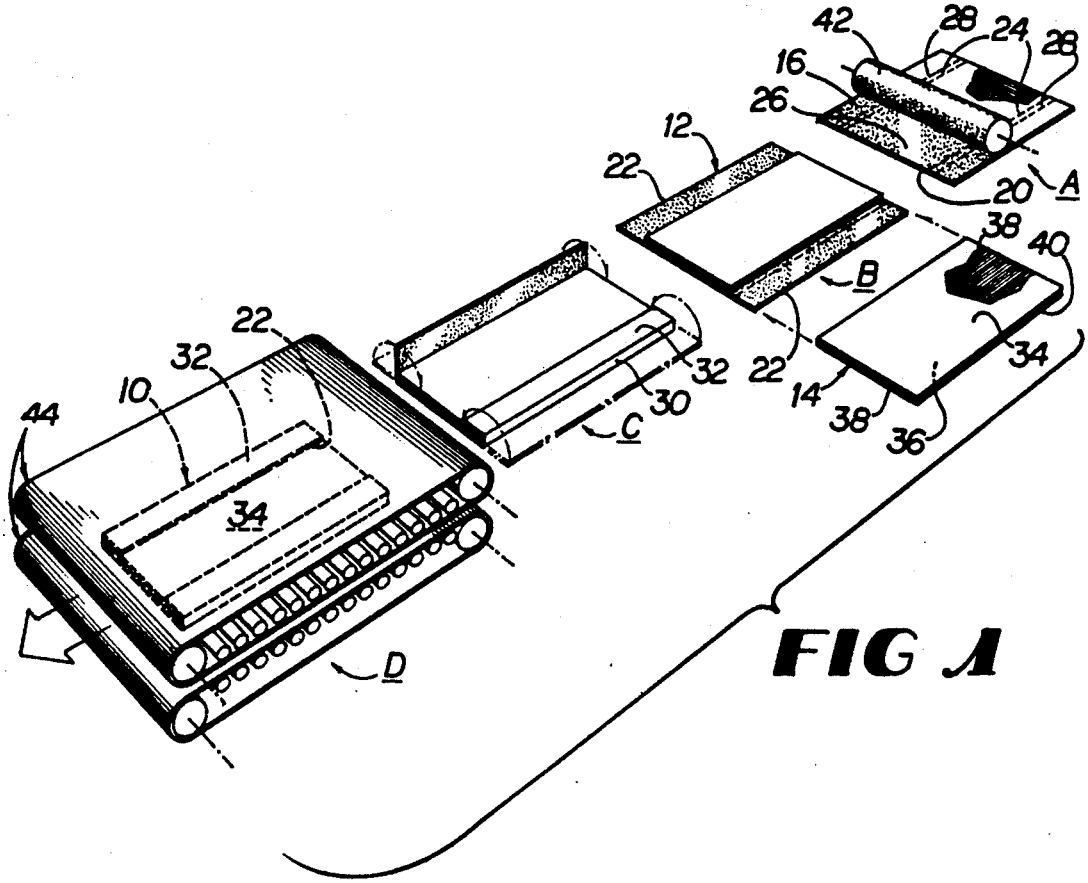
FIG. 1 is a schematic view of the steps of the self-centering lamination process of the present invention.

The first embodiment of the lamination process is shown in FIG. 1 and is as follows: glue is applied to the inner surface 16 of the blank 12 at a gluing station A by conventional means, such as a glue roll 42. The blank 12 is then moved to station B where it receives the liner 14 which is usually fed transversely to the path of travel of the blank 12. Either manually or mechanically, the bottom surface 36 of the liner 14 is placed onto the blank 12 to generally overly the central portion 26.

Figure 2A:
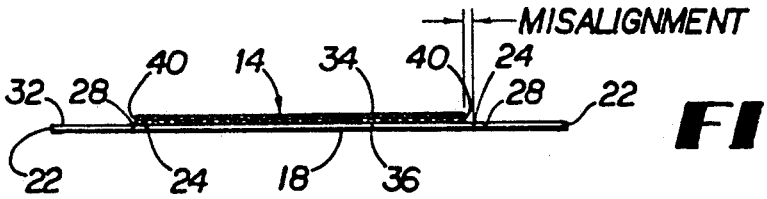
FIGS. 2A–2C are end views of the outer edge panels of the container blank being folded onto the liner member.

Care has to normally be taken so that the side walls 40 of the liner 14 are in registration with the sides of the central portion 26 defined by the first fold lines 24. FIG. 2A illustrates a misalignment of the liner 14 on the blank 12 with the distance marked "misalignment" being the space between the side walls 40 and the first fold line 24. Thus, fold lines (not shown) in the liner 14 would not be in registration with respective fold lines (also not shown) on the blank 12, resulting in uneven folding with a possible buckling in the finished product of the liner 14 on the blank 12.

Figure 2B:
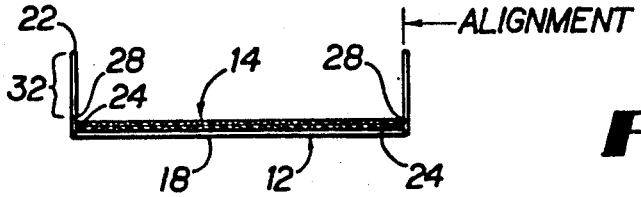
Figure 2C:
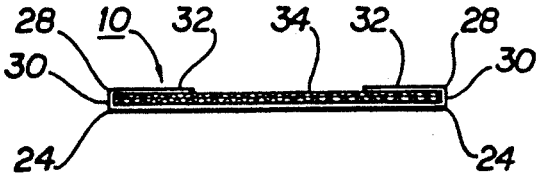

The fold lines 24, 28 and the outer edge panels 32 provide an automatic means for centering the liner 14 onto the blank 12. As seen in FIGS. 1 and 2B, the outer edge panels 32 are first bent upwardly 90° about first fold line 24 at the folding station C. During that process, any misalignment of the liner 14 in its position on blank 12 is automatically corrected. Thus, the misalignment in FIG. 2A is corrected by having the liner 14 be shifted to the right in the figure the distance of the misalignment with the liner 14 now captured between the upright outer edge panels 32. Also, while at the folding station C, the panels 32 are then folded downwardly 90° about the second fold lines 28 so that the inner surfaces of the panels 32 overlap a portion of the top surface 34 of the liner 14.

Referring again to FIG. 1, the laminated assembly 10 is then moved to station D where the assembly 10 is fed between opposed pressure rolls 44 for a predetermined glue cure time at a predetermined pressure to cement the liner 14 onto the blank 12. From station D, the assembly 10 can be moved to subsequent conventional container-erecting stations which may result in a container as shown in FIG. 4C.

Figure 4A:
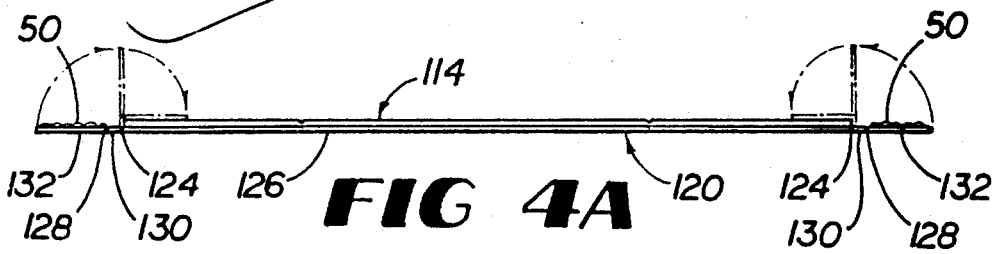
FIGS. 4A and 4B are end views of glue having been applied to the outer edge panels which are folded onto the liner and member.
Figure 4B:
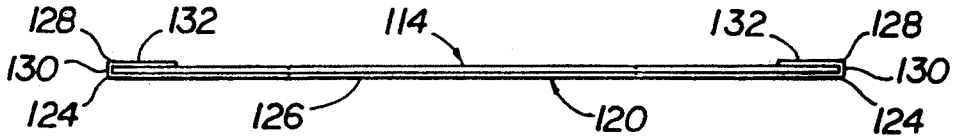
Figure 4C:
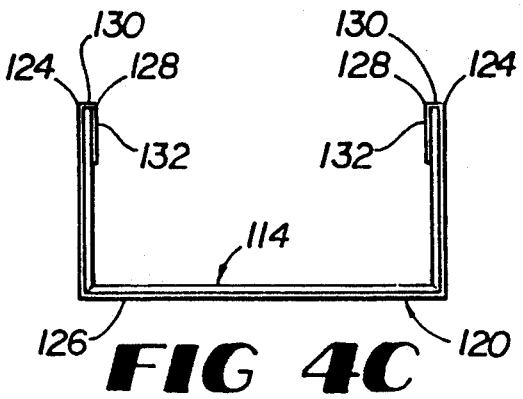
FIG. 4C is an end view of an erected container utilizing the present invention.

FIGS. 3 and 4A and 4B depict another embodiment of the carton-forming process. The liner 114 is fed between an upper feed roller 46 and a lower glue roller 48 whereby glue 50 is applied to the bottom surface 136 of the liner 114. The liner 114 is then placed generally onto the central portion 126 of the blank 120 and glue 50 is applied to the outer edge panels 132. The panels 132 are then folded about fold lines 124, 128 onto the liner 114, as described above for the first embodiment. The assembly is then indexed into the compression section, as described above, to form the laminated product.

What I claim is:

1. A method of applying a corrugated liner member, having a top surface and a bottom surface, to the inner surface of a corrugated box blank having outer side panels which have outer edges and which are capable of being folded inwardly 180° so as to form a laminated assembly, comprising:

(a) gluing the liner member onto the inner surface; and (b) folding the side panels 180°, which have glue thereon, so that the inner surface of each panel is in engagement with the top surface of the liner member, thereby forming the assembly.

2. A method as claimed in claim 1 and further comprising the step of:

(c) applying pressure to the assembly for a predetermined period of time to form a finished laminated assembly.

3. A method as claimed in claim 1 and further comprising, prior to step (a), the step of forming a pair of parallel, longitudinally extending fold lines along the inner surface of the blank adjacent each of the outer edges of the outer side panels, the distance between the fold lines of each pair of fold lines being substantially equal to the thickness of the liner member and the distance between the inner fold lines of each pair of fold lines being substantially equal to the width of the liner member.

4. A method as claimed in claim 1 wherein the gluing step comprises applying the glue to the inner surface of the blank, including the side panels thereof, and placing the liner member onto the inner surface.

5. A method as claimed in claim 1 wherein the gluing step comprises the steps of applying the glue to the bottom surface of the liner, placing the liner member onto the inner surface of the blank and administering glue to the side panels.

* * * * *